US009943204B2

(12) United States Patent
Lee et al.

(10) Patent No.: US 9,943,204 B2
(45) **Date of Patent: *Apr. 17, 2018**

(54) HAND-HELD LAUNDRY TREATING APPARATUS

(71) Applicant: LG Electronics Inc., Seoul (KR)

(72) Inventors: Junghoon Lee, Seoul (KR); Sogkie Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 260 days.

This patent is subject to a terminal disclaimer.

(21) Appl. No.: 14/685,152

(22) Filed: Apr. 13, 2015

(65) Prior Publication Data

US 2015/0292132 A1 Oct. 15, 2015

(30) Foreign Application Priority Data

Apr. 14, 2014 (KR) ..... 10-2014-0044255
Apr. 14, 2014 (KR) ..... 10-2014-0044256

(51) Int. Cl.

| | |
|---|---|
| ***A47L 7/00*** | (2006.01) |
| ***A47L 11/00*** | (2006.01) |
| ***D06F 5/00*** | (2006.01) |
| ***D06F 43/00*** | (2006.01) |
| ***B05B 9/08*** | (2006.01) |
| ***D06B 1/02*** | (2006.01) |
| ***B05B 15/04*** | (2006.01) |

(52) U.S. Cl.

CPC ..... *A47L 11/00* (2013.01); *B05B 9/0811* (2013.01); *B05B 15/0425* (2013.01); *D06F 43/002* (2013.01)

(58) Field of Classification Search

CPC .... A47L 7/0004; A47L 7/0009; A47L 7/0014; A47L 7/0019; A47L 7/0023; A47L 7/0038; A47L 7/0042; A47L 7/009; A47L 5/26; A47L 11/4088; D06F 5/00; D06F 43/002; B05B 9/0811; B05B 15/0425; D06B 1/02

See application file for complete search history.

(56) References Cited

U.S. PATENT DOCUMENTS 2,588,000 A * 3/1952 Hines ..... A47L 5/26 15/320
3,099,028 A * 7/1963 Ardito ..... A47L 11/1625 15/50.1
3,206,787 A * 9/1965 Daniels ..... A47L 11/30 15/320

(Continued)

*Primary Examiner* — David G Cormier
(74) *Attorney, Agent, or Firm* — Birch, Stewart, Kolasch & Birch, LLP

(57) ABSTRACT

A hand-held laundry treating apparatus includes a portable body for storing wash water and contaminated water, supplying wash water according to positive pressure air supplied into the portable body, collecting contaminated water generated during washing of a laundry item using negative pressure air created during generation of the positive pressure air, and washing a localized portion of the laundry item while being in contact with the laundry item placed on a vertical plane or a horizontal plane, and a water tank separately mounted at the portable body for storing wash water to be supplied when washing the localized portion of the laundry item placed on the vertical plane or the horizontal plane and contaminated water generated after washing of the laundry item.

24 Claims, 17 Drawing Sheets

(56) References Cited

U.S. PATENT DOCUMENTS

| | | | | |
|---|---|---|---|---|
| 3,964,925 | A * | 6/1976 | Burgoon | A47L 11/34 134/21 |
| 4,069,541 | A * | 1/1978 | Williams | A47L 11/34 15/321 |
| 4,167,341 | A * | 9/1979 | Doyel | B08B 3/12 134/118 |
| 4,356,590 | A * | 11/1982 | Goldsmith | A47L 11/4044 15/321 |
| 4,595,420 | A * | 6/1986 | Williams, III | A47L 11/30 134/21 |
| 5,367,740 | A | 11/1994 | Mccray | |
| 5,507,068 | A | 4/1996 | Fan et al. | |
| 5,599,401 | A | 2/1997 | Brosky et al. | |
| 6,347,428 | B1 | 2/2002 | Shimko et al. | |
| 7,225,503 | B1 | 6/2007 | Lenkiewicz et al. | |
| 7,784,148 | B2 * | 8/2010 | Lenkiwicz | A47L 9/0036 15/320 |
| 2002/0073504 | A1 | 6/2002 | Hall et al. | |
| 2004/0200007 | A1 | 10/2004 | Heim | |
| 2006/0185113 | A1 * | 8/2006 | Kloeppel | A47L 11/34 15/320 |
| 2013/0199573 | A1 * | 8/2013 | Joyner | A47L 11/34 134/21 |

* cited by examiner (a)

(b)

HAND-HELD LAUNDRY TREATING APPARATUS

Pursuant to 35 U.S.C. § 119(a), this application claims the benefit of Korean Patent Applications Nos. 10-2014-0044255 and 10-2014-0044256, filed on Apr. 14, 2014, which are hereby incorporated by reference as if fully set forth herein.

BACKGROUND OF THE INVENTION

Field of the Invention

The present invention relates to a hand-held laundry treating apparatus and, more particularly, to a hand-held laundry treating apparatus that is capable of washing a portion of laundry that is contaminated.

Discussion of the Related Art

In general, a laundry treating apparatus is an apparatus that removes various kinds of contaminants from laundry using emulsification of detergent, frictional force and impulsive force generated in a stream of water due to the rotation of a pulsator (or a drum), etc.

A conventional laundry treating apparatus generally includes a tub for receiving wash water and a drum rotatably provided in the tub for receiving laundry. In the conventional laundry treating apparatus, therefore, laundry is introduced into the drum, wash water is supplied to the tub, and the drum is rotated to wash the laundry.

In the conventional laundry treating apparatus, however, all of the laundry is introduced into the tub in which wash water is received, even when only a portion of the laundry is contaminated. For this reason, the conventional laundry treating apparatus is not suitable for washing a locally contaminated portion of the laundry.

In a case in which the laundry is locally contaminated, it is desirable to supply wash water or detergent to the contaminated portion of the laundry such that the contaminations can be removed from the laundry. In the conventional laundry treating apparatus, however, more wash water, detergent, and power are consumed than may be necessary.

Therefore, there is a need for a laundry treating apparatus that is capable of washing only a contaminated portion of laundry.

SUMMARY OF THE INVENTION

Accordingly, the present invention is directed to a hand-held laundry treating apparatus that substantially obviates one or more problems due to limitations and disadvantages of the related art.

An object of the present invention is to provide a hand-held laundry treating apparatus that is capable of washing only a contaminated portion of laundry.

Another object of the present invention is to provide a hand-held laundry treating apparatus that is capable of spraying detergent and/or wash water to laundry and, in addition, collecting liquid remaining in the laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the present invention provides a hand-held laundry treating apparatus including a portable body for storing wash water and contaminated water, supplying wash water according to positive pressure air supplied into the portable body, collecting contaminated water generated during washing of laundry using negative pressure air created during generation of the positive pressure air, and washing a localized portion of the laundry while being in contact with the laundry placed on a vertical plane or a horizontal plane, and a water tank separately mounted at the portable body for storing wash water to be supplied when washing the localized portion of the laundry placed on the vertical plane or the horizontal plane and contaminated water generated after washing of the laundry.

The portable body may include a fluid feeding unit for supplying and collecting air of a predetermined pressure to circulate the air, a washing unit for spraying the wash water to the laundry and collecting the contaminated water, and a vibration unit for applying vibration to the laundry when the wash water is sprayed to the laundry.

The portable body may further include a circulation channel unit for guiding the air supplied from the fluid feeding unit to the water tank, guiding the wash water from the water tank to the washing unit, guiding the wash water collected from the washing unit to the water tank, and guiding air collected in the water tank together with the contaminated water to the fluid feeding unit.

The circulation channel unit may include a pump connection block at which an air pump for circulating the air is mounted, a tank fastening block at which the water tank is mounted, an air channel block defining a path for circulating the air between the pump connection block and the tank fastening block, and a water channel block defining paths of the wash water and the contaminated water between the tank fastening block and the washing unit.

The fluid feeding unit may include an air pump and a motor for transmitting a driving force to the air pump, the air pump including a discharge port for supplying pressurized air and a collection port for collecting the air, the air pump being fastened to the pump connection block, and the pump connection block may include a discharge channel, to which the discharge port is connected, and a suction channel, to which the collection port is connected.

The air channel block may include a discharge extension channel extending a moving path of air moving through the discharge channel to the tank fastening block and a suction extension channel extending a moving path of air from the water tank moving through the tank fastening block to the suction channel.

The tank fastening block may include a sealing groove at which the water tank is mounted, an air supply hole, to which the discharge extension channel is connected, for supplying air to the water tank, a wash water supply hole, through which the wash water in the water tank extruded by the air moves, a contaminated water collection hole for collecting the contaminated water generated in the washing unit, and an air collection hole, to which the suction extension channel is connected, for collecting the air from the water tank.

The water channel block may include a wash water supply channel connected to the wash water supply hole for guiding the wash water in the water tank to the washing unit and a contaminated water collection channel connected to the contaminated water collection hole for guiding the contaminated water in the washing unit to the contaminated water collection hole.

The washing unit may include a wash water spray nozzle connected to the wash water supply channel for spraying the wash water to a surface of the laundry and a contaminated water collection port connected to the contaminated water collection channel for collecting the contaminated water generated from the laundry.

The vibration unit may include a motor for generating a rotational force, an eccentric rotary shaft for converting the rotational force of the motor into a linear reciprocating motion, and a vibrator coupled to the eccentric rotary shaft for applying vibration to the laundry.

The vibration unit may further include a movable gasket disposed between the vibrator and the washing unit for sealing the wash water and the contaminated water.

The vibration unit may include a solenoid performing a linear reciprocating motion and a vibrator coupled to an end of the solenoid for applying vibration to the laundry.

The vibration unit may further include a movable gasket disposed between the vibrator and the washing unit for sealing the wash water and the contaminated water.

The portable body may further include a rechargeable power supply unit for supplying power to the fluid feeding unit and the vibration unit.

The portable body may be provided at one side thereof with a manipulation unit for controlling operation of the portable body.

The portable body may be provided at one side thereof with an indication unit for indicating an operation state of the portable body.

The water tank may include a body formed in the shape of a box, a partition wall for partitioning an internal space of the body into a wash water storage unit for storing the wash water and a contaminated water storage unit for storing the contaminated water, and a fastening unit formed at a lower part of the body such that the fastening part is fastened to the portable body for defining a communication space between the wash water storage unit and the contaminated water storage unit.

The fastening unit may include an air introduction boss for supplying external air to the wash water storage unit, a wash water discharge boss for discharging the wash water stored in the wash water storage unit, a contaminated water introduction boss for introducing the contaminated water into the contaminated water storage unit, and an air collection boss for discharging the air introduced into the contaminated water storage unit together with the contaminated water.

The fastening unit may further include a sealing protrusion formed in a shape surrounding the air introduction boss, the wash water discharge boss, the contaminated water introduction boss, and the air collection boss.

The wash water storage unit may include a first air introduction channel extending from the air introduction boss to an upper part of the wash water storage unit and a second air introduction channel connected to an upper part of the first air introduction channel such that the second air introduction channel is open at a lower part of the wash water storage unit.

The wash water storage unit may include a first wash water discharge channel extending from the wash water discharge boss to an upper part of the wash water storage unit and a second wash water discharge channel connected to an upper part of the first wash water discharge channel such that the second wash water discharge channel is open at a lower part of the wash water storage unit.

The contaminated water storage unit may include a contaminated water introduction channel extending from the contaminated water introduction boss to an upper part of the contaminated water storage unit such that the contaminated water introduction channel is open at the upper part of the contaminated water storage unit.

The contaminated water storage unit may include an air collection channel extending from the air collection boss to an upper part of the contaminated water storage unit such that the air collection channel is open at the upper part of the contaminated water storage unit.

The wash water storage unit may be provided at a lower part thereof with a water supply hole for supplying the wash water, the contaminated water storage unit may be provided at a lower part thereof with a drainage hole for draining the contaminated water, and the water tank may be provided at a lower part thereof with water supply and drainage caps for opening and closing the water supply hole and the drainage hole.

The portable body may include a housing forming an external appearance thereof, the housing may be provided at a middle part thereof with a water tank mounting unit at which the water tank is mounted, and the water tank mounting unit may include a turning clamp for fixing the water tank.

The housing may be provided at a top thereof with a curved part, having a predetermined curvature, pressed by the turning clamp according to turning of the turning clamp and a catching projection for restricting the turning of the turning clamp.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

In the following description of the present invention, names of constituent elements are defined in consideration of functions in the present invention. Therefore, the names of the constituent elements must not be construed as meanings restricting technical elements of the present invention. In addition, the names defined form the respective constituent elements may be called other names in the art to which the present invention pertains.

A hand-held laundry treating apparatus 10 according to the present invention is a device for washing a contaminated portion of laundry. The hand-held laundry treating apparatus 10 has a structure configured to be held by a user. In particular, the hand-held laundry treating apparatus 10 according to the present invention is configured to supply wash water to a contaminated portion of the laundry and to collect contaminated water (including wash water, detergent, and contaminants; hereinafter, referred to 'contaminated water') remaining in the laundry.

Figure 1:
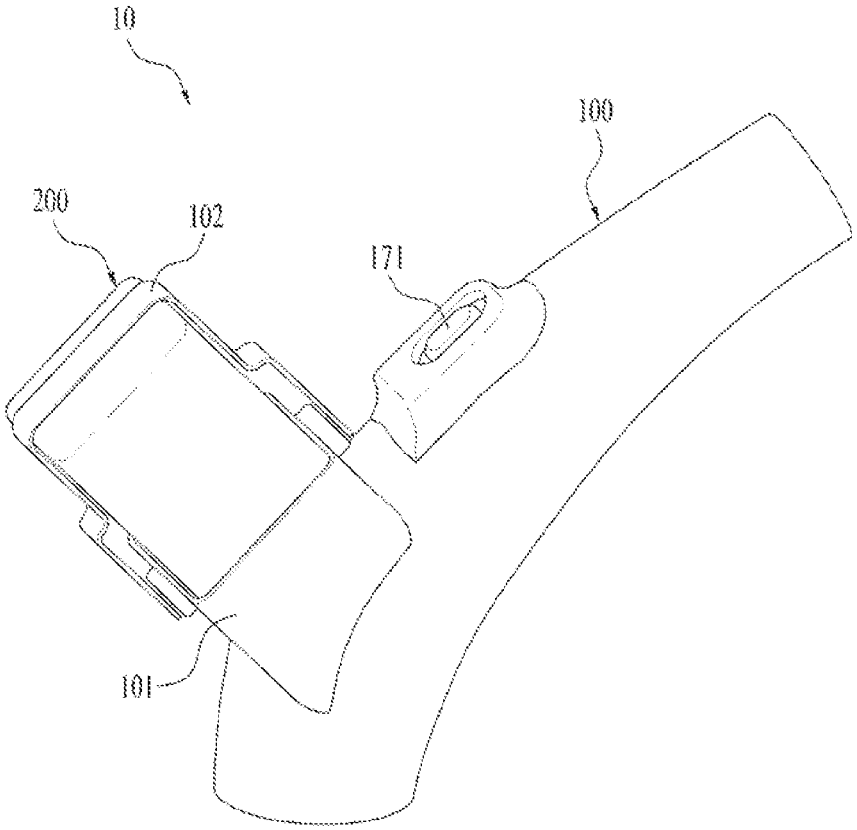
FIG. 1 is a perspective view showing a hand-held laundry treating apparatus according to the present invention.

Hereinafter, a hand-held laundry treating apparatus according to an embodiment of the present invention will be described with reference to the accompanying drawings. FIG. 1 is a perspective view showing a hand-held laundry treating apparatus according to the present invention, and FIG. 2 is a sectional view showing the internal structure of the hand-held laundry treating apparatus according to the present invention.

Figure 2:
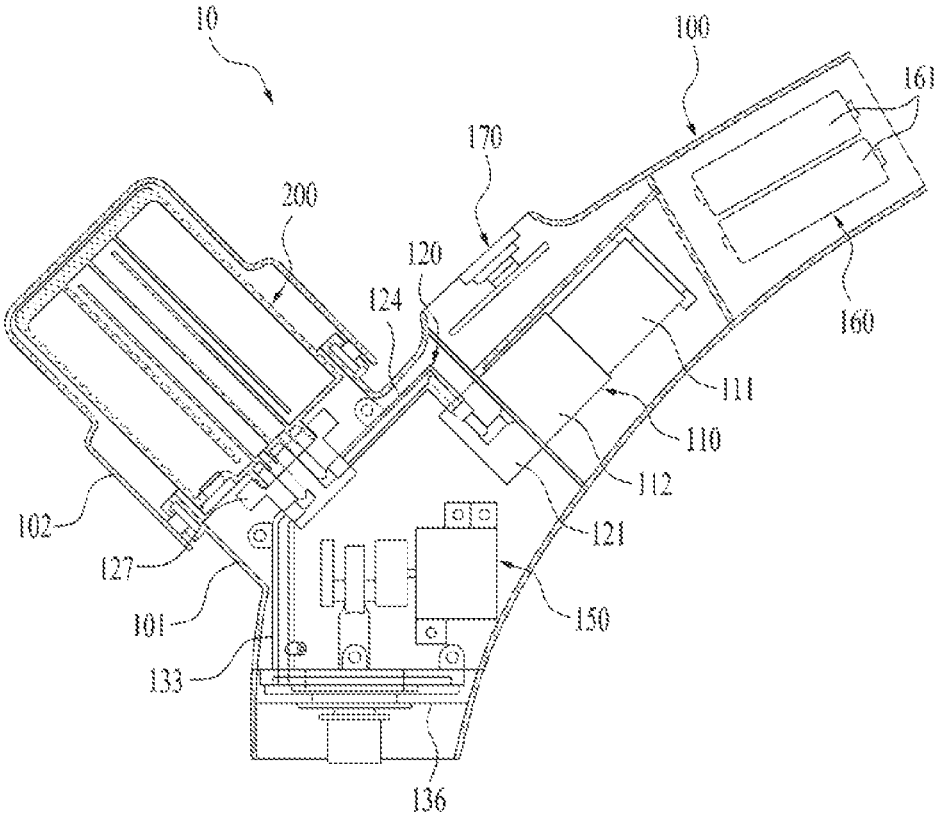
FIG. 2 is a sectional view showing the internal structure of the hand-held laundry treating apparatus according to the present invention.

As shown in FIGS. 1 and 2, the hand-held laundry treating apparatus 10 according to the present invention includes a portable body 100 having a handle configured to be held by a user and defining a main body of the hand-held laundry treating apparatus 10 for washing a contaminated portion of laundry and a water tank 200 separately mounted at the upper side of the portable body 100 for storing wash water necessary for washing and wash water (hereinafter, referred to as 'contaminated water') containing detergent and contaminants collected after washing of the laundry.

The portable body 100 includes a fluid feeding unit 110 for circulating air of a predetermined pressure to supply the wash water stored in the water tank 200 to the contaminated portion of the laundry and, at the same time, to collect contaminated water remaining in the laundry into the water tank 200, a circulation channel unit 120 defining a channel of the air supplied from the fluid feeding unit 110 and a channel of wash water 40 and contaminated water 50 (see FIG. 15), a washing unit 136 for supplying the wash water guided by the circulation channel unit 120 and, at the same time, for collecting contaminated water generated after washing of the laundry, a vibration unit 150 for performing washing using the wash water 40 guided by the circulation channel unit 120, a power supply unit 160 for supplying power to the fluid feeding unit 110 and the vibration unit 150, a manipulation unit 170 for controlling the power supplied from the power supply unit 160, an indication unit 180 (see FIG. 13) for indicating an operation state of the hand-held laundry treating apparatus 10, and a controller 190 (see FIG. 13) for controlling the fluid feeding unit 110, the vibration unit 150, and the indication unit 180 under control of the manipulation unit 170.

The portable body 100 further includes a pair of separable housings (not shown). The fluid feeding unit 110, the circulation channel unit 120, the washing unit 136, the vibration unit 150, the power supply unit 160, the manipulation unit 170, the indication unit 180, and the controller 190 may be mounted in the housings or exposed from the housings. The portable body 100 may be formed in various shapes. For example, the portable body 100 may be formed in the shape of a cylinder having a predetermined curvature such that the portable body 100 can be easily held by a user.

The power supply unit 160 supplies power to the respective electronic components, including the vibration unit 150, the manipulation unit 170, the indication unit 180, and the controller 190 provided in the portable body 100.

The power supply unit 160 may supply power using an ordinary disposable dry cell 161. Alternatively, the power supply unit 160 may include an external power supply unit (not shown) for receiving external power supplied from the outside of the portable body 100 and supplying the received external power to the respective electronic components of the portable body 100.

In a case in which the power supply unit 160 includes the external power supply unit, the power supply unit 160 may further include a converter (not shown) for converting external AC power into DC power. Various embodiments of the power supply unit 160 may be provided, and a detailed description thereof will be omitted.

The manipulation unit 170 is provided at the outside of the portable body 100. The manipulation unit 170 may include a power switch 171 for controlling the power supplied from the power supply unit 160 and an intensity adjustment switch (not shown) for controlling intensity of the vibration unit 150, which will hereinafter be described.

The indication unit 180 is provided at the outside of the portable body 100 (specifically, one side of the manipulation unit 170). The indication unit 180 may include an operation indicating lamp (not shown) turned on when power is supplied according to the operation of the manipulation unit 170 and an alarm indicating lamp (not shown) turned on when the hand-held laundry treating apparatus 10 malfunctions due to lack of power, lack of water, etc.

The controller 190 controls the respective electronic components of the portable body 100 when power is supplied according to the operation of the manipulation unit 170 provided at the outside of the portable body 100.

The water tank 200 includes a wash water storage unit 210 (see FIG. 10) for storing wash water supplied by the pressurized air of the predetermined pressure supplied from the fluid feeding unit 110 and a contaminated water storage unit 220 (see FIG. 10) for collecting and storing contaminated water generated after washing is performed by the vibration unit 150.

A water tank mounting unit 101, in which the water tank 200 is mounted, is formed at a middle part of the portable body 100. The water tank mounting unit 101 is provided such that a tank fastening block 127 (see FIG. 4) of the circulation channel unit 120, which will hereinafter be described, is exposed. Turning clamps 102 are provided at opposite sides of the water tank mounting unit 101, which are turned to press and fasten the water tank 200. The turning clamps 102 will be described in detail in the description of the water tank 200.

The water tank mounting unit 101 is formed at the middle part of the portable body 100 such that wash water can be supplied to the circulation channel unit 120 of the portable body 100 through the water tank mounting unit 101.

The hand-held laundry treating apparatus 10 according to the present invention washes laundry 20 which is placed on a horizontal plane and laundry 20 which is placed on a vertical plane. In addition, the portable body 100 may be used at about 45 degrees to the horizontal plane or at about 45 degrees to the vertical plane according to a use state of the hand-held laundry treating apparatus 10. The use state of the hand-held laundry treating apparatus 10 is not particularly restricted and may vary depending upon a placement state of the laundry 20.

It is necessary for the water tank 200 mounted at the portable body 100 to supply wash water irrespective of a use state of the portable body 100. To this end, the water tank 200 may be mounted perpendicular to the portable body 100.

In this case, the water tank 200 mounted at the portable body 100 may be maintained at about 45 degrees to the horizontal plane in a clockwise direction or in a counterclockwise direction irrespective of the use state of the portable body 100. In this case, wash water stored in the water tank 200 may be smoothly supplied irrespective of the use state of the portable body 100.

The mounting state of the water tank 200 mounted at the portable body 100 is not particularly restricted. For example, the water tank 200 mounted at the portable body 100 may have a margin angle of 15 degrees to the vertical plane of the portable body 100 in the counterclockwise direction or a margin angle of 15 degrees to the vertical plane of the portable body 100 in the clockwise direction.

That is, the water tank 200 may be mounted at the portable body 100 at an angle of about 30 to 60 degrees to the vertical plane in the counterclockwise direction to wash laundry placed on the horizontal plane according to the use state of the portable body 100. On the other hand, the water tank 200 may be mounted at the portable body 100 at an angle of about 30 to 60 degrees to the vertical plane in the clockwise direction to wash laundry placed on the vertical plane according to the use state of the portable body 100.

Consequently, the mounting angle of the water tank 200 may be changed such that the lower part of the water tank 200 is continuously located at a position lower than the upper part of the water tank 200 irrespective of the use state of the portable body 100.

In addition, one end of the portable body 100 is used as a handle and the other end of the portable body 100 is used as the washing unit 136 for washing the laundry 20 since the portable body 100 is used in a state in which the portable body 100 is held by a user. In this case, the water tank mounting unit 101 may be formed between the washing unit 136 and the handle of the portable body 100.

In addition, the portable body 100 may be formed in the form of a curve having a predetermined curvature such that the user can easily and conveniently hold and use the portable body 100. In this case, the water tank mounting unit 101 may be formed at a middle part of the convex side of the curved portable body 100.

Hereinafter, the respective components of the hand-held laundry treating apparatus 10 according to the present invention will be described in detail with reference to the accompanying drawings.

Figure 3:
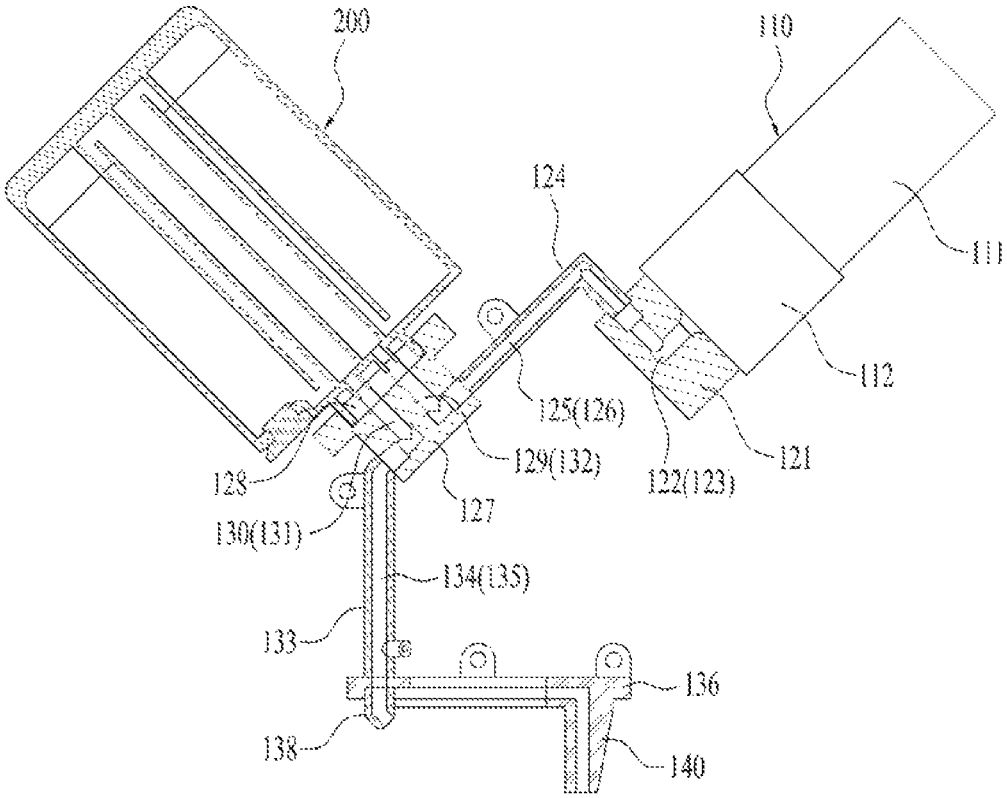
FIG. 3 is a schematic view showing a fluid feeding unit and a circulation channel unit of the hand-held laundry treating apparatus according to the present invention.
Figure 4:
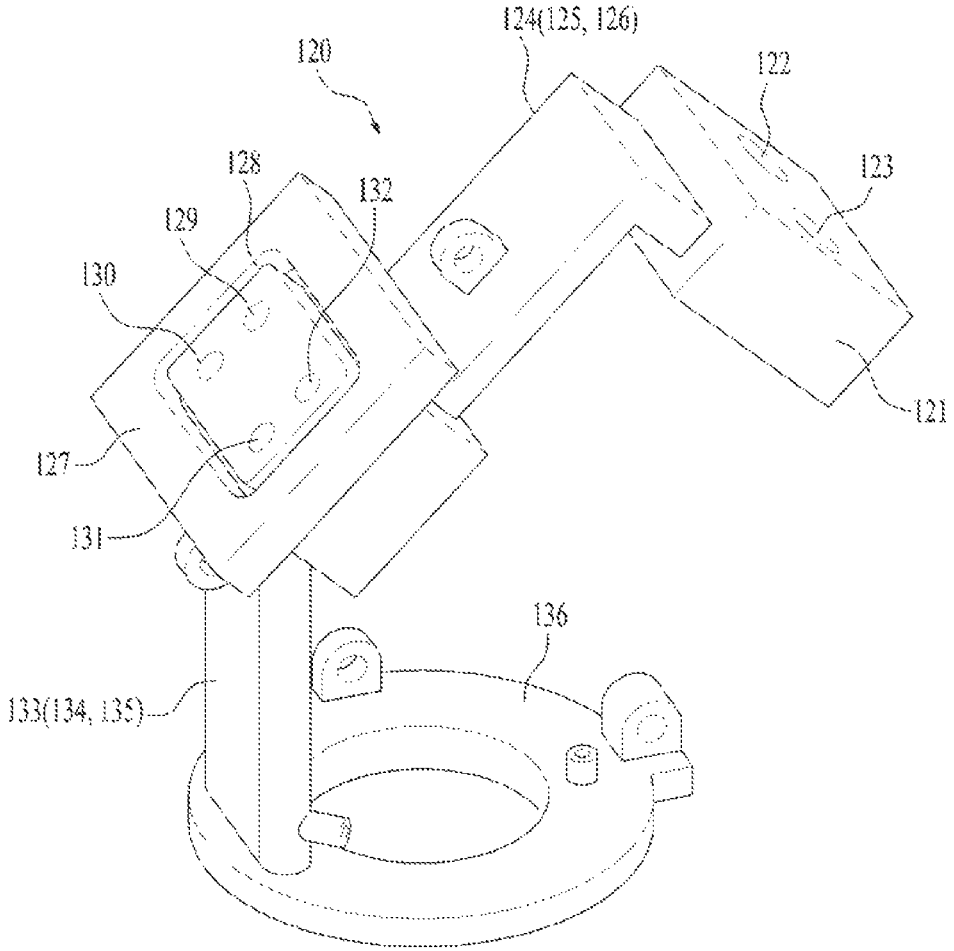
FIG. 4 is an enlarged perspective view showing principal parts of the circulation channel unit of the hand-held laundry treating apparatus according to the present invention.

First, the fluid feeding unit 110 and the circulation channel unit 120 of the hand-held laundry treating apparatus 10 according to the present invention will be described in detail with reference to FIGS. 3 and 4. FIG. 3 is a schematic view showing the fluid feeding unit and the circulation channel unit of the hand-held laundry treating apparatus according to the present invention, and FIG. 4 is an enlarged perspective view showing principal parts of the circulation channel unit of the hand-held laundry treating apparatus according to the present invention.

The fluid feeding unit 110 includes a motor 111 for generating a driving force and an air pump 112 for circulating air. The air pump 112 includes a discharge port 113 (see FIG. 13) for supplying a high-pressure air through the circulation channel unit 120 and a collection port 114 (see FIG. 13) for collecting air through the circulation channel unit 120. Various embodiments of the motor 111 and the air pump 112 constituting the fluid feeding unit 110 may be provided, and a detailed description thereof will be omitted.

The circulation channel unit 120 includes a pump connection block 121, to which the air pump 112 of the fluid feeding unit 110 is fastened, a tank fastening block 127, to which the water tank 200 is fastened, an air channel block 124 connected between the pump connection block 121 and the tank fastening block 127 and defining a channel for circulating air between the water tank fastened to the tank fastening block 127 and the air pump 112 fastened to the pump connection block 121, and a water channel block 133 extending from the tank fastening block 127 to the washing unit 136 and defining a channel for supplying wash water to the washing unit 136 and a channel for collecting contaminated water generated after washing of the laundry.

The pump connection block 121 is formed in the shape of a block to which the air pump 112 is fastened. The pump connection block 121 is provided with a discharge channel 122, to which the discharge port 113 of the air pump 112 is connected, and a suction channel 123, to which the collection port 114 of the air pump 112 is connected. The pump connection block 121 and the air pump 112 are separately coupled to each other via an additional fastening member (not shown).

The tank fastening block 127 is provided at one side thereof with a sealing groove 128, to which the water tank 200 is fastened. At the inside of the sealing groove 128, an air supply hole 129, a wash water supply hole 130, a contaminated water collection hole 131, and an air collection hole 132 are formed at the tank fastening block 127.

The air supply hole 129 and the air collection hole 132 are connected to the discharge channel 122 and the suction channel 123 via the air channel block 124, and the wash water supply hole 130 and the contaminated water collection hole 131 are connected to the washing unit 136 via the water channel block 133.

The air channel block 124 is connected between the pump connection block 121 and the tank fastening block 127. The air channel block 124 includes a discharge extension channel 125 connected between the discharge channel 122 of the pump connection block 121 and the air supply hole 129 of the tank fastening block 127 and a suction extension channel 126 connected between the air collection hole 132 of the tank fastening block 127 and the suction channel 123 of the pump connection block 121.

The water channel block 133 is connected between the tank fastening block 127 and the washing unit 136. The water channel block 133 is provided with a wash water supply channel 134, along which the wash water 40 stored in the wash water storage unit 210 of the water tank 200 moves to the washing unit 136, and a contaminated water collection channel 135, along which contaminated water 50 generated after the laundry 20 is washed by the washing unit 136 moves to the contaminated water storage unit 220 of the water tank 200.

The washing unit 136 is located under the water channel block 133. The washing unit 136 includes a wash water spray nozzle 138 for spraying the wash water 40 supplied from the wash water supply channel 134 of the water channel block 133 to the laundry 20, and a contaminated water collection port 140 (see FIG. 5) for suctioning and collecting the contaminated water 50 generated after the laundry 20 is washed. The washing unit 136 will be described in detail in the description of the vibration unit 150.

The wash water spray nozzle 138 may be directly connected to the wash water supply channel 134 of the water channel block 133. Alternatively, the wash water spray nozzle 138 may be connected to the wash water supply channel 134 of the water channel block 133 via an additional movable bellows type connection pipe (not shown). In addition, the contaminated water collection port 140 of the washing unit 136 may be directly connected to the contaminated water collection channel 135 of the water channel block 133. Alternatively, the contaminated water collection port 140 of the washing unit 136 may be connected to the contaminated water collection channel 135 of the water channel block 133 via an additional movable bellows type connection pipe (not shown).

The fluid feeding unit 110 and the circulation channel unit 120 as described above are operated to move a fluid as follows.

First, the air pump 112 of the fluid feeding unit 110 generates air of a predetermined pressure according to the operation of the motor 111. Pressure higher than atmospheric pressure (hereinafter, referred to as "positive pressure") is formed at the discharge port 113 of the air pump 112, and pressure lower than the atmospheric pressure (hereinafter, referred to as "negative pressure") is formed at the collection port 114 of the air pump 112.

The air of the predetermined pressure discharged from the discharge port 113 of the air pump 112 moves to the air supply hole 129 of the tank fastening block 127 via the discharge channel 122 of the pump connection block 121 and the discharge extension channel 125 of the air channel block 124 and is then supplied to the wash water storage unit 210 of the water tank 200.

The pressurized air supplied to the wash water storage unit 210 applies predetermined pressure to wash water 40 in the wash water storage unit 210. The wash water 40 flows along the wash water supply channel 134 of the water channel block 133 and is then sprayed to laundry 20 through the wash water spray nozzle 138 of the washing unit 136.

The wash water 40 sprayed to the laundry 20 washes the laundry according to the operation of the vibration unit 150 and is then changed into contaminated water 50. The contaminated water 50 is collected into the contaminated water storage unit 220 of the water tank 200 due to the negative pressure of the air pump 112.

That is, since the suction channel 123 of the pump connection block 121, the suction extension channel 126 of the air channel block 124, the contaminated water storage unit 220 of the water tank 200, and the contaminated water collection channel 135 of the water channel block 133 are connected to the collection port 114 of the air pump 112, negative pressure is formed at the suction channel 123 of the pump connection block 121, the suction extension channel 126 of the air channel block 124, the contaminated water storage unit 220 of the water tank 200, and the contaminated water collection channel 135 of the water channel block 133 according to the operation of the air pump 112.

When the wash water 40 is sprayed through the wash water spray nozzle 138 of the washing unit 136 according to the operation of the air pump 112, the water is suctioned to the contaminated water collection port 140 due to negative pressure formed at the contaminated water collection port 140.

Subsequently, the water is introduced into the contaminated water storage unit 220 of the water tank 200 fastened to the tank fastening block 127 via the contaminated water collection channel 135 of the water channel block 133. At this time, the contaminated water 50 is introduced into the contaminated water storage unit 220 together with air. The air is separated from the contaminated water 50 in the contaminated water storage unit 220. The separated air is introduced into the collection port 114 of the air pump 112 via the suction extension channel 126 of the air channel block 124 and the suction channel 123 of the pump connection block 121.

Figure 5:
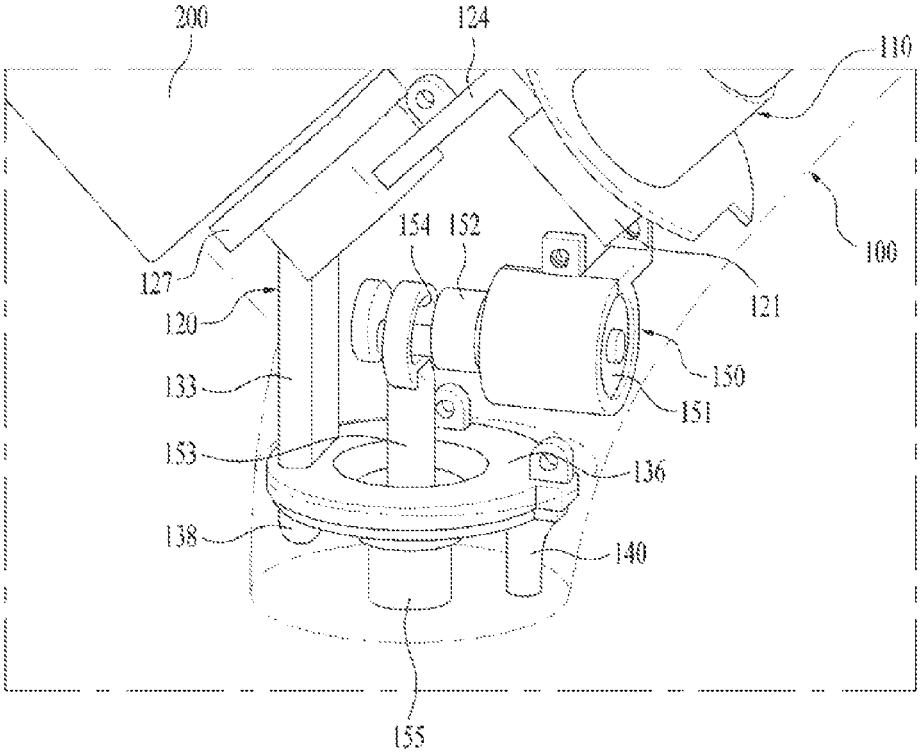
FIG. 5 is a partial perspective view showing a vibration unit of the hand-held laundry treating apparatus according to the present invention.
Figure 6:
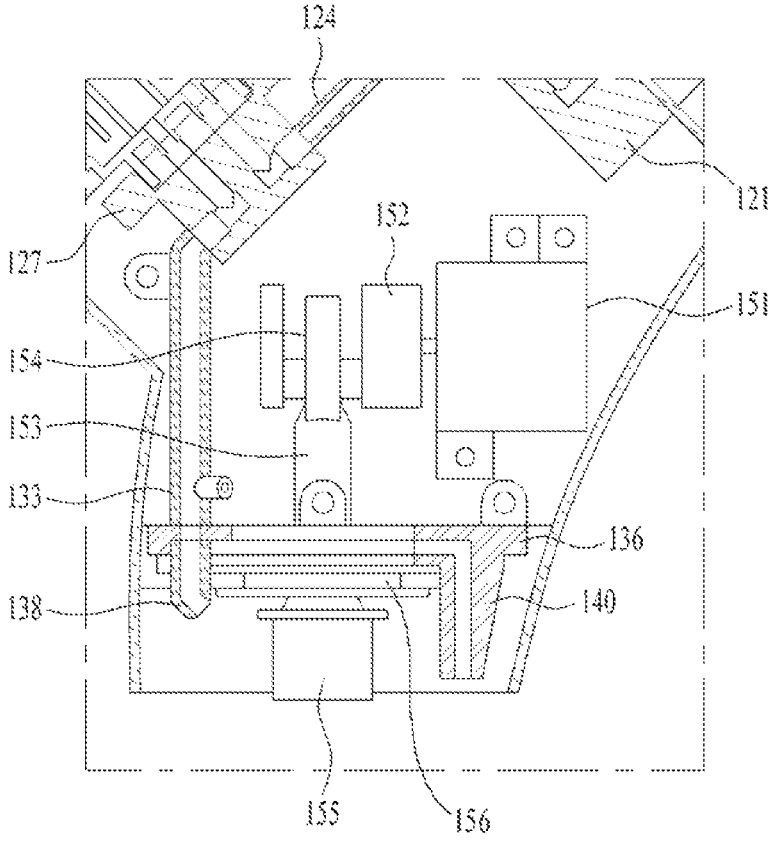
FIG. 6 is a partial sectional view showing the vibration unit of the hand-held laundry treating apparatus according to the present invention.
Figure 7:
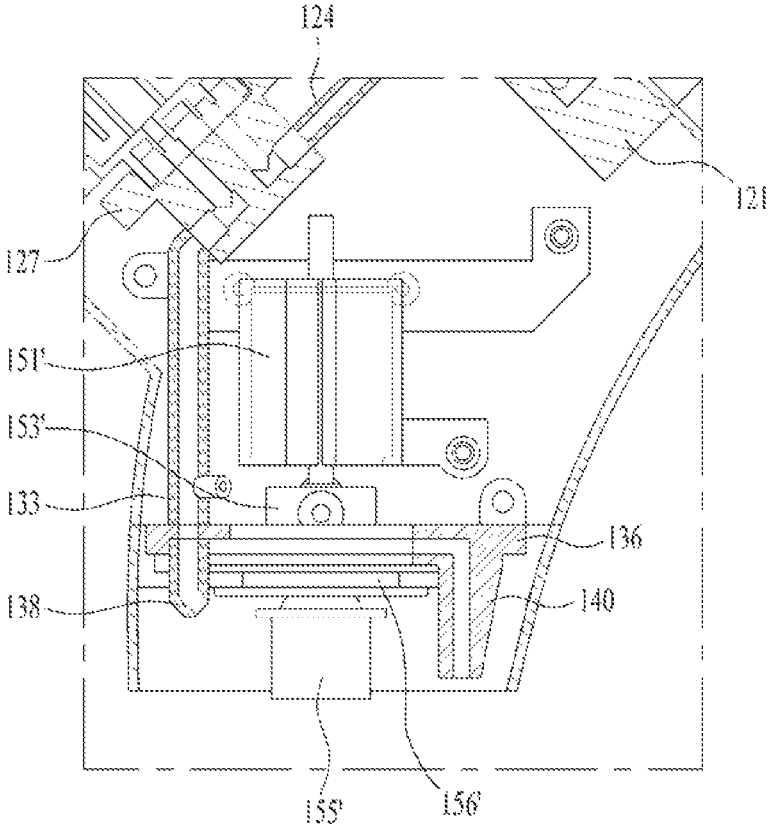
FIG. 7 is a partial sectional view showing another embodiment of the vibration unit of the hand-held laundry treating apparatus according to the present invention.

Hereinafter, the washing unit 136 and the vibration unit 150 of the hand-held laundry treating apparatus according to the present invention will be described in detail with reference to FIGS. 5 to 7. FIG. 5 is a partial perspective view showing the vibration unit of the hand-held laundry treating apparatus according to the present invention, FIG. 6 is a partial sectional view showing the vibration unit of the hand-held laundry treating apparatus according to the present invention, and FIG. 7 is a partial sectional view showing another embodiment of the vibration unit of the hand-held laundry treating apparatus according to the present invention.

Meanwhile, two embodiments of the vibration unit 150 having different structures for generating vibration are provided according to the present invention. The respective embodiments will be described with reference to the accompanying drawings. In addition, a vibration unit according to an embodiment of the present invention is associated with the washing unit. Therefore, the washing unit will first be described in detail.

A washing unit and a vibration unit according to an embodiment of the present invention will be described with reference to FIGS. 5 and 6.

The washing unit 136 has a washing unit body located at the lower end of the water channel block 133 having a through hole formed at a middle part thereof. The washing unit body is provided at one side thereof with a wash water spray nozzle 138 connected to the wash water supply channel 134 of the water channel block 133 and at the other side thereof with a contaminated water collection port 140 connected to the contaminated water collection channel 135 of the water channel block 133.

The washing unit 136 is located in a space formed at the lower part of the portable body 100 in a depressed state such that the washing unit 136 is not exposed outward due to tight contact between the portable body 100 and laundry 20 during washing of the laundry 20.

In addition, the wash water spray nozzle 138 is spaced apart from the laundry 20 by a predetermined distance to widely spray wash water to the surface of the laundry 20. The wash water spray nozzle 138 is provided to spray wash water 40 to a vibrator 153 of the vibration unit 150, which will hereinafter be described.

The contaminated water collection port 140 is provided to collect contaminated water 50 generated from the laundry by the vibration unit 150. The contaminated water collection port 140 is located at a position of the portable body 100 at which the portable body 100 is in tight contact with the surface of the laundry.

Meanwhile, the vibration unit 150 is located at one side of the wash water spray nozzle 138 of the washing unit 136 for applying predetermined vibration to the laundry 20 as well as the wash water 40 to improve a washing effect. The vibration unit 150 includes a motor 151 for generating a driving force, an eccentric rotary shaft 152 for transmitting rotational force of the motor 151, a vibrator 153 vibrated by the eccentric rotary shaft 152, and a movable gasket 156 for sealing a space between the vibrator 153 and the washing unit 136.

The vibrator 153 is provided at an upper side end thereof with an eccentric rotary shaft groove 154, into which the eccentric rotary shaft 152 of the motor 151 is rotatably inserted, and at a lower side end thereof with a striking block 155 for directly striking the laundry 20 while being disposed in direct contact with the laundry 20 according to the rotation of the motor 151. The striking block 155 of the vibrator 153 directly strikes the laundry to improve washing efficiency.

Hereinafter, a vibration unit 150' according to another embodiment of the present invention will be described with reference to FIG. 7. The vibration unit 150' according to the embodiment of the present invention shown in FIG. 7 is different from the vibration unit 150 according to the previous embodiment of the present invention in terms of a vibration structure for generating vibration. A washing unit 136 associated with the vibration 150' is identical to the one of the previous embodiment of the present invention, and a detailed description thereof will be omitted.

The vibration unit 150' according to the embodiment of the present invention includes a solenoid 151' for generating vibration, a vibrator 153' for striking laundry 20 while being disposed in contact with the laundry 20 according to the operation of the solenoid 151', and a movable gasket 156' for sealing a space between the vibrator 153' and the washing unit 136.

The vibrator 153' is provided at a lower side end thereof with a striking block 155' for directly striking the laundry 20 while being disposed in direct contact with the laundry 20 according to the to the operation of the solenoid 151'. The striking block 155' of the vibrator 153' directly strikes the laundry to improve washing efficiency.

Figure 8:
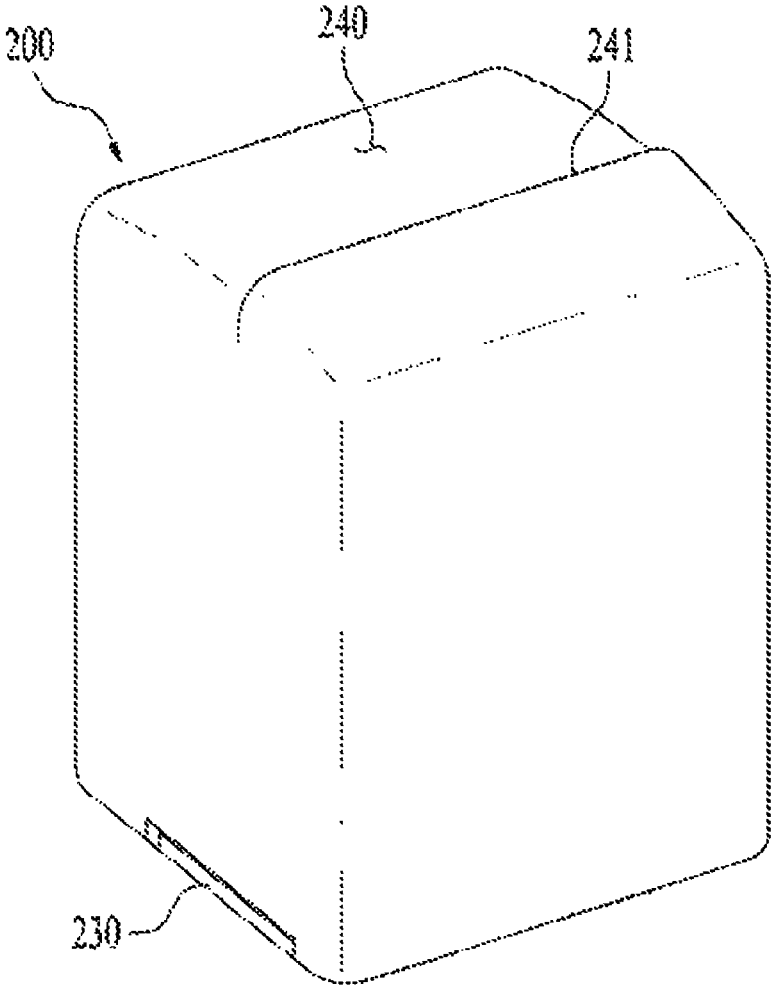
FIGS. 8 and 9 are perspective views showing a water tank of the hand-held laundry treating apparatus according to the present invention.
Figure 9:
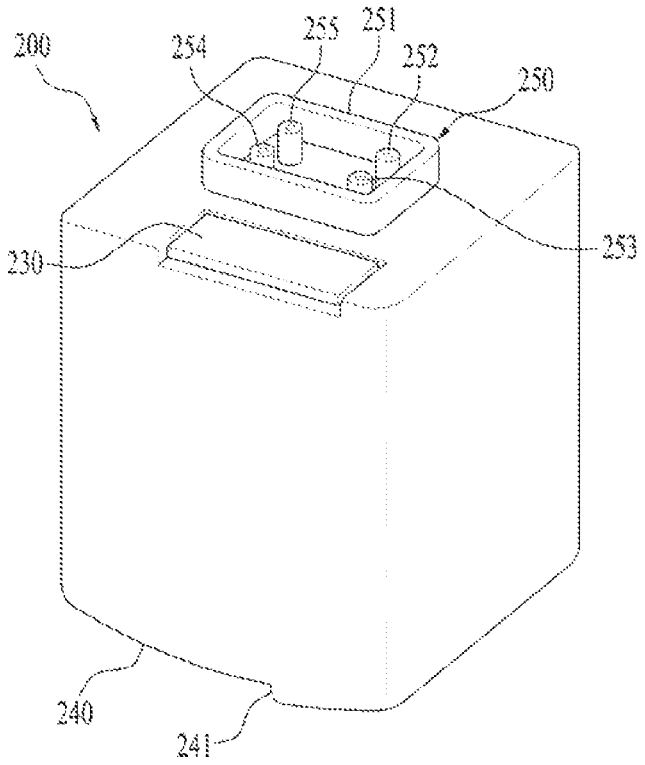
Figure 10:
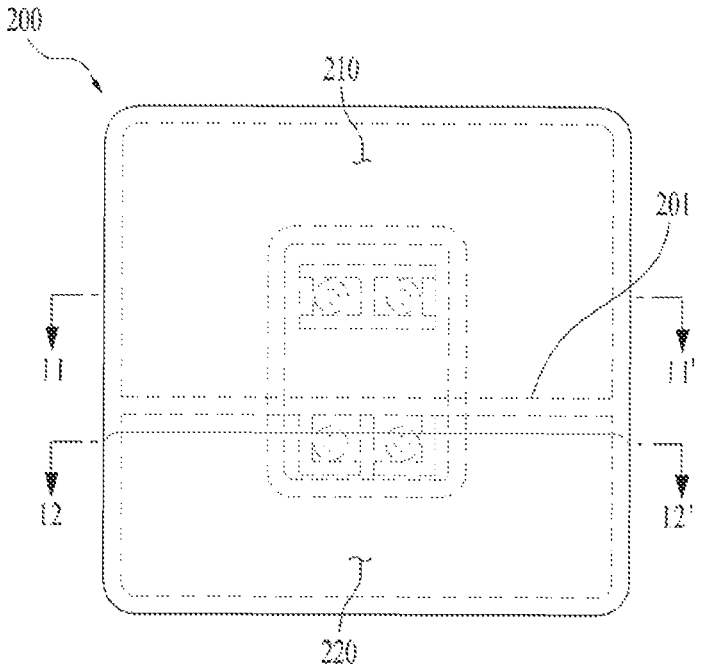
FIG. 10 is a plan view showing the internal structure of the water tank of the hand-held laundry treating apparatus according to the present invention.
Figure 11:
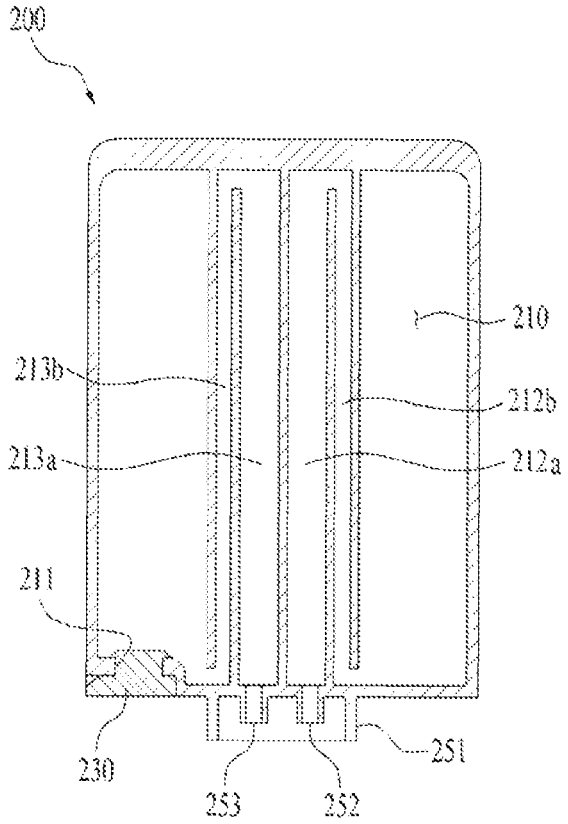
FIG. 11 is a sectional view taken along line 11-11' of FIG. 10.
Figure 12:
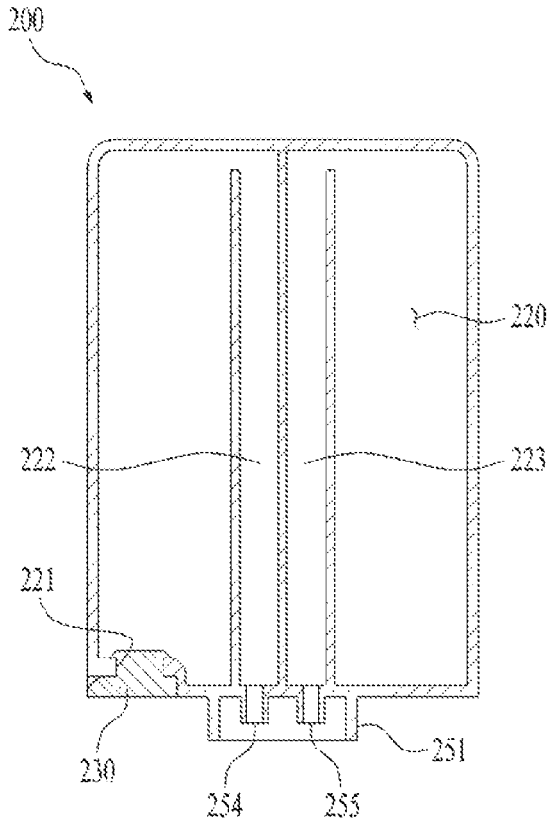
FIG. 12 is a sectional view taken along line 12-12' of FIG. 10.

Hereinafter, the water tank 200 of the hand-held laundry treating apparatus according to the present invention will be described in detail with reference to FIGS. 8 to 12. FIGS. 8 and 9 are perspective views showing the water tank of the hand-held laundry treating apparatus according to the present invention, FIG. 10 is a plan view showing the internal structure of the water tank of the hand-held laundry treating apparatus according to the present invention, FIG. 11 is a sectional view taken along line 11-11' of FIG. 10, and FIG. 12 is a sectional view taken along line 12-12' of FIG. 10. Specifically, FIG. 11 is a sectional view showing the wash water storage unit of the water tank, and FIG. 12 is a sectional view showing the contaminated water storage unit of the water tank.

As shown in FIGS. 8 to 10, the water tank 200 is formed in the shape of a box having a space defined therein. The water tank 200 is provided at the top thereof with a curved part 240 which is pressed by the turning clamps 102 provided at the water tank mounting unit 101, and at the bottom thereof with a fastening unit 250 mounted at the tank fastening block 127 exposed from the water tank mounting unit 101.

The curved part 240 is provided at one side thereof with a catching projection 241 for restricting turning of the turning clamps 102. The fastening unit 250 is provided with a sealing protrusion 251, which is inserted into the sealing groove 128 formed at the tank fastening block 127. An air introduction boss 252, a wash water discharge boss 253, a contaminated water introduction boss 254, and an air collection boss 255 are formed at the fastening unit 250 at the inside of the sealing protrusion 251, which are respectively inserted into the air supply hole 129, the wash water supply hole 130, the contaminated water collection hole 131, and the air collection hole 132 provided at the tank fastening block 127.

A partition wall 201 for partitioning the water tank 200 into two spaces is provided in the water tank 200. The wash water storage unit 210 is located at one side of the partition wall 201, and the contaminated water storage unit 220 is located at the other side of the partition wall 201.

A water supply hole 211 for supplying wash water to the wash water storage unit 210 is formed at the lower end of the wash water storage unit 210, and a drainage hole 221 for draining contaminated water from the contaminated water storage unit 220 is formed at the lower end of the contaminated water storage unit 220.

In addition, water supply and drainage caps 230 for blocking the water supply hole 211 of the wash water storage unit 210 and the drainage hole 221 of the contaminated water storage unit 220 are provided at the lower end of the water tank 200, specifically, at one side of the water supply hole 211 and one side of the drainage hole 221.

The air introduction boss 252, the wash water discharge boss 253, the contaminated water introduction boss 254, and the air collection boss 255 are located at the wash water storage unit 210 and the contaminated water storage unit 220 in a partitioned state. Specifically, the air introduction boss 252 and the wash water discharge boss 253 are formed at the wash water storage unit 210, and the contaminated water introduction boss 254 and the air collection boss 255 are formed at the contaminated water storage unit 220.

As shown in FIG. 11, a first air introduction channel 212*a* communicating with the air introduction boss 252 and a second air introduction channel 212*b* communicating with the upper part of the first air introduction channel 212*a* and the lower side of the wash water storage unit 210 are formed in the wash water storage unit 210.

In addition, a first wash water discharge channel 213*a* communicating with the wash water discharge boss 253 and a second wash water discharge channel 213*b* communicating with the upper part of the first wash water discharge channel 213*a* and the lower side of the wash water storage unit 210 are formed at one side of the first air introduction channel 212*a*.

The first and second air introduction channels 212*a* and 212*b* and the first and second wash water discharge channels 213*a* and 213*b* are formed at a middle part of the wash water storage unit 210 while being respectively adjacent to each other in a symmetric fashion. The first and second air introduction channels 212*a* and 212*b* and the first and second wash water discharge channels 213*a* and 213*b* are double-structure channels. Consequently, introduction and discharge of wash water 40 are carried out at the lower part of the wash water storage unit 210.

That is, according to the operation of the air pump, air is introduced into the first air introduction channel 212*a* via the air introduction boss 252, is guided into the second air introduction channel 212*b* connected to the upper part of the first air introduction channel 212*a*, and is supplied from the lower part of the second air introduction channel 212*b* to the wash water storage unit 210 to increase pressure in the wash water storage unit 210.

Due to the increase of the pressure in the wash water storage unit 210, wash water 40 stored in the wash water storage unit 210 is introduced into the second wash water discharge channel 213*b*, is guided to the first wash water discharge channel 213*a* connected to the upper part of the second wash water discharge channel 213*b*, and is discharged through the wash water discharge boss 253.

In addition, as shown in FIG. 12, a contaminated water introduction channel 222 communicating with the contaminated water introduction boss 254 is formed in the contaminated water storage unit 220, and an air collection channel 223 communicating with the air collection boss 255 is formed at one side of the contaminated water introduction channel 222.

The contaminated water introduction channel 222 and the air collection channel 223 extend from the bottom of the contaminated water storage unit 220 such that the upper parts of the contaminated water introduction channel 222 and the air collection channel 223 communicate with the contaminated water storage unit 220. The contaminated water introduction channel 222 and the air collection channel 223 are formed at a middle part of the contaminated water storage unit 220 in a symmetric fashion.

That is, as the air is exhausted from the contaminated water storage unit 220 via the air collection boss 255 and the air collection channel 223 according to the operation of the air pump 112, pressure in the contaminated water storage unit 220 is lowered. As the pressure in the contaminated water storage unit 220 is lowered, contaminated water 50 is introduced into the contaminated water introduction boss 254. The introduced contaminated water 50 flows along the contaminated water introduction channel 222 and is introduced into the contaminated water storage unit 220 from the upper part of the contaminated water introduction channel 222.

In the water tank 200 of the hand-held laundry treating apparatus according to the present invention as described above, the water tank 200 is partitioned into the wash water storage unit 210 and the contaminated water storage unit 220 by way of example. Alternatively, the wash water storage unit 210 and the contaminated water storage unit 220 may be constituted by separate tanks such that the wash water storage unit 210 and the contaminated water storage unit 220 can be individually separably mounted at the portable body 100.

In the wash water storage unit 210 and the contaminated water storage unit 220 of the water tank 200 as described above, the supply of air, the supply of wash water, the introduction of contaminated water, and the collection of air are carried out at the lower part of the water tank 200 mounted at the water tank mounting unit 101 of the portable body 100.

Therefore, even when laundry 20 placed on a horizontal plane or laundry 20 placed on a vertical plane is washed using the portable body 100, the supply of air, the supply of wash water, the introduction of contaminated water, and the collection of air may be smoothly carried out.

Hereinafter, the operation of the hand-held laundry treating apparatus according to the present invention will be described in detail. It should be noted that elements of the hand-held laundry treating apparatus mentioned in the following description be understood with reference to the above description and the drawings.

Figure 13:
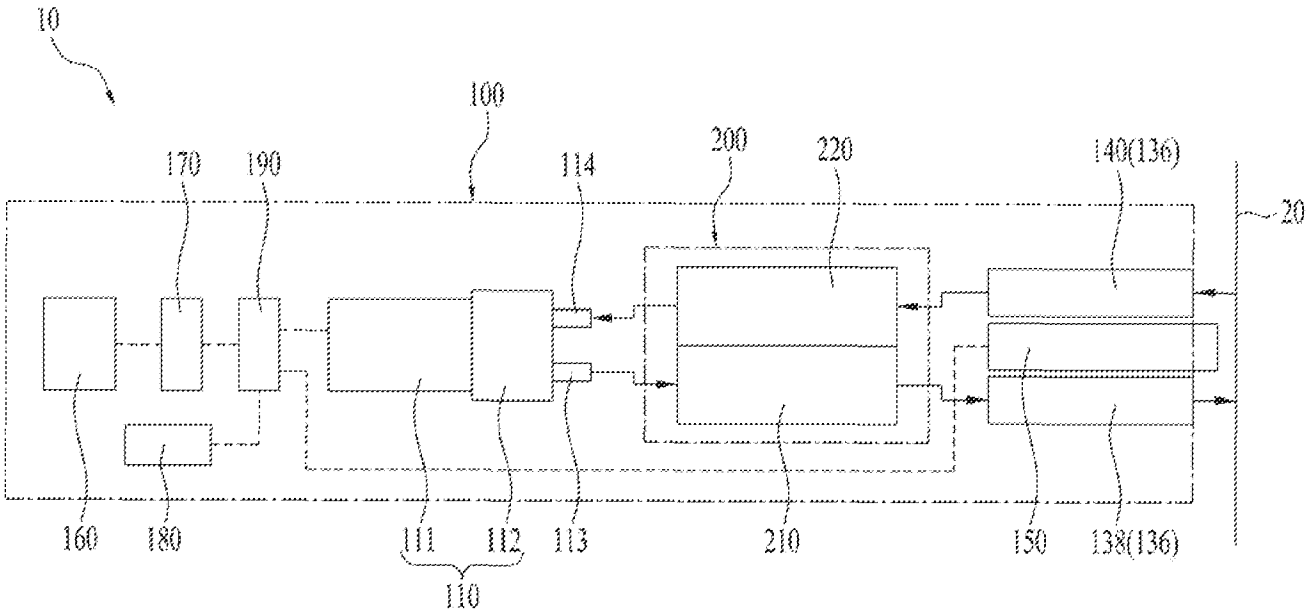
FIG. 13 is a schematic view showing a channel structure and signal connection of the hand-held laundry treating apparatus according to the present invention.

First, power, a control signal, and fluid channel connection of the hand-held laundry treating apparatus as described above will be described with reference to FIG. 13. FIG. 13 is a schematic view showing a channel structure and signal connection of the hand-held laundry treating apparatus according to the present invention.

As shown, power of the power supply unit 160 is connected to the manipulation unit 170, and the manipulation unit 170 is electrically connected to the controller 190. Meanwhile, the fluid feeding unit 110, the vibration unit 150, and the indication unit 180 are connected to the controller 190. The fluid feeding unit 110, the vibration unit 150, and the indication unit 180 are controlled by the controller 190. The fluid feeding unit 110, the vibration unit 150, and the indication unit 180 are operated according to a control signal of the controller 190.

A manipulation signal according to the operation of the manipulation unit 170 is input to the controller 190. The controller 190 controls the fluid feeding unit 110, the vibration unit 150, and the indication unit 180 connected to the controller 190.

Specifically, the controller 190 controls power to be supplied to the motor 111 of the fluid feeding unit 110 such that pressurized air is generated by the air pump 112. As a result, positive pressure is formed at the discharge port of the air pump to forcibly feed air.

The pressurized air generated by the air pump 112 sequentially passes through the discharge port 113 of the air pump 112, the discharge channel 122 of the pump connection block 121, the discharge extension channel 125 of the air channel block 124, and the air supply hole 129 of the tank fastening block 127, and is then supplied to the wash water storage unit 210 of the water tank 200.

The pressurized air moves to the wash water storage unit 210 of the water tank 200 via the air introduction boss 252 of the water tank 200 and the first air introduction channel 212*a* and the second air introduction channel 212*b* of the wash water storage unit 210 to increase pressure in the wash water storage unit 210.

Due to the increase of the pressure in the wash water storage unit 210, wash water 40 stored in the wash water storage unit 210 is introduced into the second wash water discharge channel 213*b*, is guided to the first wash water discharge channel 213*a* connected to the upper part of second wash water discharge channel 213*b*, and is discharged through the wash water discharge boss 253.

Subsequently, the wash water 40 discharged through the wash water discharge boss 253 flows along the wash water supply channel 134 of the water channel block 133 and is then sprayed to laundry through the wash water spray nozzle 138 provided at the washing unit 136.

When the wash water 40 is sprayed through the wash water spray nozzle 138, the controller 190 controls the vibration unit 150 to strike a localized portion of the laundry 20 to which the wash water 40 is sprayed such that the laundry 20 is washed.

Specifically, the motor 151 of the vibration unit 150 is operated as power is supplied to the motor 151 under control of the controller 190. According to the operation of the motor 151, the vibrator 153 connected to the eccentric rotary shaft 152 of the motor 151 vibrates. As a result, the striking block 155 formed at the end of the vibrator 153 strikes the surface of the laundry 20 to which the wash water is sprayed such that the laundry 20 is washed.

During the above process, negative pressure is formed at the collection port 114 of the air pump 112 according to the operation of the air pump 112. As a result, negative pressure is also formed at the suction channel 123 of the pump connection block 121, the suction extension channel 126 of the air channel block 124, the contaminated water storage unit 220 of the water tank 200, and the contaminated water collection channel 135 of the water channel block 133 connected to the collection port 114 of the air pump 112.

Consequently, contaminated water 50 generated after washing is performed by the vibration unit 150 using the wash water sprayed through the wash water spray nozzle 138 of the washing unit 136 is suctioned into the contaminated water collection port 140 due to the negative pressure formed at the contaminated water collection port 140, flows along the contaminated water collection channel 135 of the water channel block 133 connected to the contaminated water collection port 140, and is introduced into the contaminated water storage unit 220 of the water tank 200 through the contaminated water collection hole 131 of the tank fastening block 127. At the same time, air around the contaminated water collection port 140 is introduced into the contaminated water collection port 140 together with the contaminated water 50. The air is also introduced into the contaminated water storage unit 220 together with the contaminated water 50.

The contaminated water 50 and the air are introduced into the contaminated water storage unit 220 via the contaminated water introduction channel 222 of the contaminated water storage unit 220 and are discharged to the lower part of the contaminated water storage unit 220 from the upper part of the contaminated water storage unit 220. The air introduced together with the contaminated water 50 is separated from the contaminated water 50 and stays in the upper part of the contaminated water storage unit 220. The contaminated water 50 is stored in the lower part of the contaminated water storage unit 220 due to gravity.

The air staying in the contaminated water storage unit 220 is introduced into the contaminated water collection channel 135 and moves to the suction extension channel 126 of the air channel block 124 through the air collection hole 132 of the tank fastening block 127. Subsequently, the air is introduced into the collection port 114 of the air pump 112 via the suction channel 123 of the pump connection block 121.

Consequently, the air is supplied and collected to the water tank 200 according to the operation of the air pump 112, and the wash water 40 is supplied and collected to the water tank 200 according to the operation of the air pump 112.

The hand-held laundry treating apparatus according to the present invention may have various operation modes based on the placement of laundry. Hereinafter, only typical operation modes of the hand-held laundry treating apparatus will be described in detail.

Figure 14:
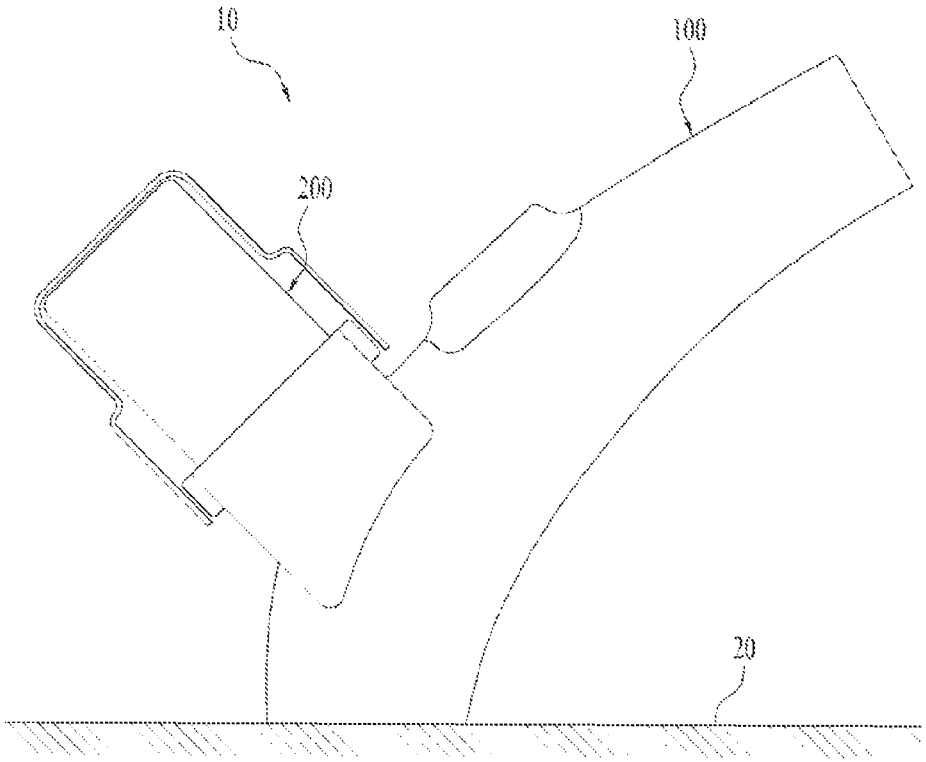
FIG. 14 is a side view showing a first use state of the hand-held laundry treating apparatus according to the present invention.

First, a first use state of the hand-held laundry treating apparatus according to the present invention will be described with reference to FIGS. 14 and 15. FIG. 14 is a side view showing the first use state of the hand-held laundry treating apparatus according to the present invention, and FIG. 15 is a schematic view showing the movement of wash water and contaminated water according to the first use state of the hand-held laundry treating apparatus according to the present invention.

FIG. 14 shows an operation state of the hand-held laundry treating apparatus according to an embodiment of the present invention in which laundry 20 is placed on a horizontal plane, and the washing unit 136 of the portable body 100 is used in contact with the laundry placed on the horizontal plane. In this use state, the water tank 200 mounted at the portable body 100 is located at an angle of about 45 degrees to a vertical line in a counterclockwise direction.

Figure 15:
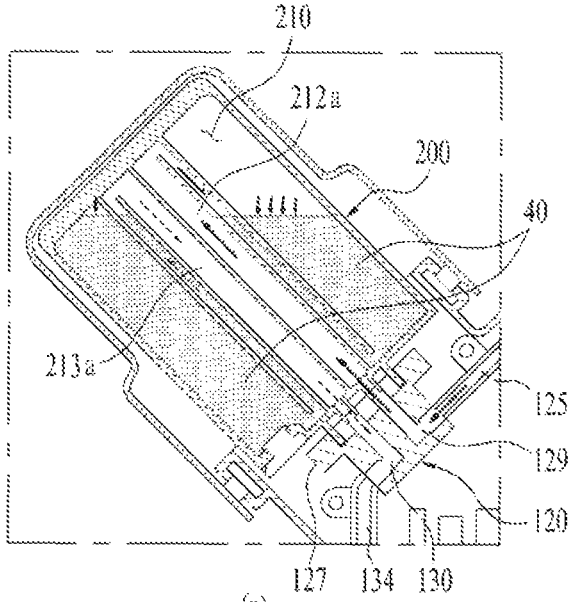
FIG. 15 is a schematic view showing the movement of wash water and contaminated water according to the first use state of the hand-held laundry treating apparatus according to the present invention.
Figure 15:
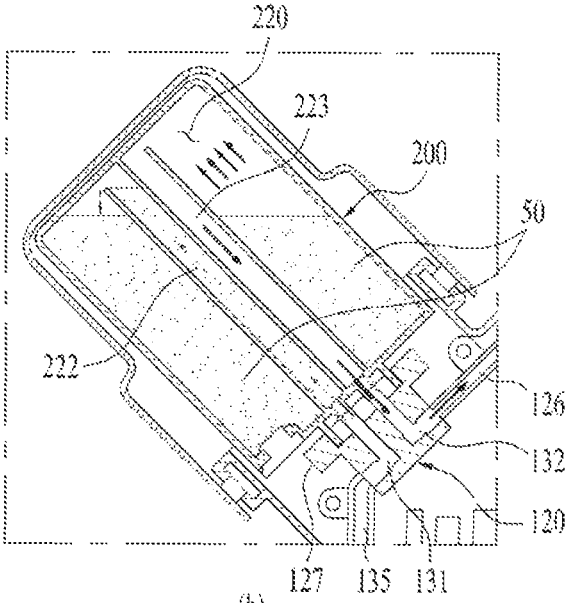

In the use state as described above, wash water 40 is stored in the water tank 200 as shown in FIG. 15(*a*). According to the operation of the air pump 112, air is supplied to the wash water storage unit 210 of the water tank 200 via the air introduction boss 252 of the water tank 200 and the first air introduction channel 212*a* and the second air introduction channel 212*b* of the wash water storage unit 210 to increase pressure in the wash water storage unit 210.

Due to the increase of the pressure in the wash water storage unit 210, the wash water 40 stored in the wash water storage unit 210 is introduced into the second wash water discharge channel 213*b*, is guided to the first wash water discharge channel 213*a* connected to the upper part of the second wash water discharge channel 213*b*, and is discharged through the wash water discharge boss 253.

In addition, contaminated water 50 generated after washing of the laundry 20 is suctioned into the contaminated water collection port 140 due to negative pressure formed at the contaminated water collection port 140, flows along the contaminated water collection channel 135 of the water channel block 133 connected to the contaminated water collection port 140, and is introduced into the contaminated water storage unit 220 of the water tank 200 through the contaminated water collection hole 131 of the tank fastening block 127.

At the same time, air around the contaminated water collection port 140 is introduced into the contaminated water collection port 140 together with the contaminated water 50. The air is also introduced into the contaminated water storage unit 220 together with the contaminated water 50. At this time, the contaminated water 50 is stored in the contaminated water storage unit 220 of the water tank 200 as shown in FIG. 15(*b*).

Figure 16:
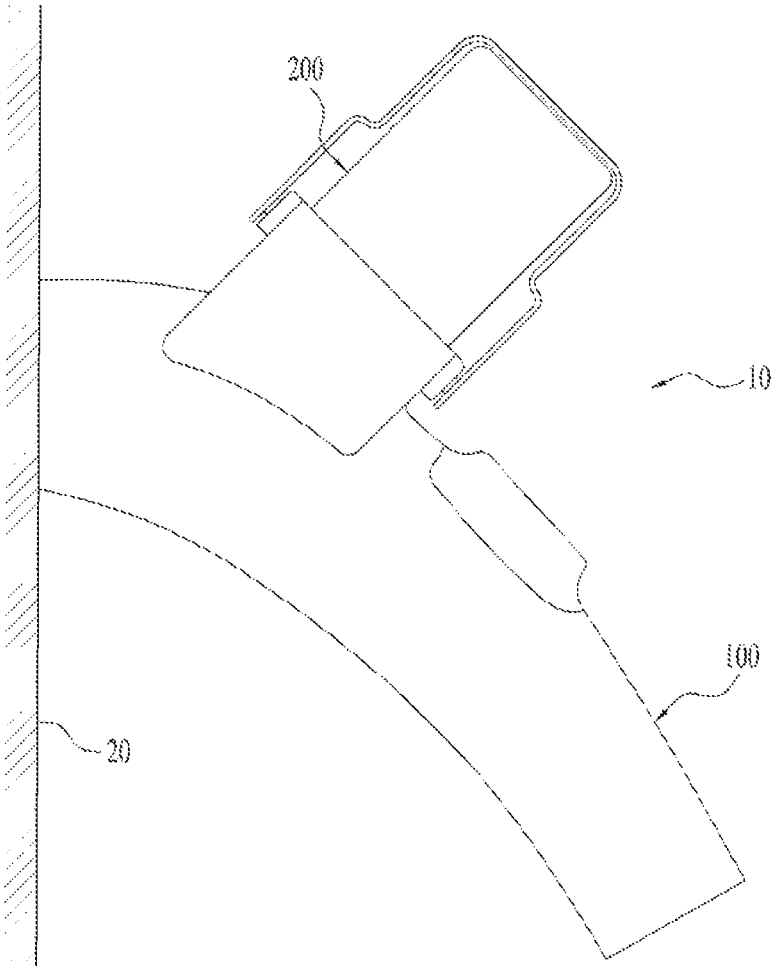
FIG. 16 is a side view showing a second use state of the hand-held laundry treating apparatus according to the present invention.

Hereinafter, a second use state of the hand-held laundry treating apparatus according to the present invention will be described with reference to FIGS. 16 and 17. FIG. 16 is a side view showing the second use state of the hand-held laundry treating apparatus according to the present invention, and FIG. 17 is a schematic view showing the movement of wash water and contaminated water according to the second use state of the hand-held laundry treating apparatus according to the present invention.

FIG. 16 shows an operation state of the hand-held laundry treating apparatus according to another embodiment of the present invention in which laundry 20 is placed on a vertical plane, and the washing unit 136 of the portable body 100 is used in contact with the laundry placed on the vertical plane. In this use state, the water tank 200 mounted at the portable body 100 is located at an angle of about 45 degrees to a vertical line in a clockwise direction.

Figure 17:
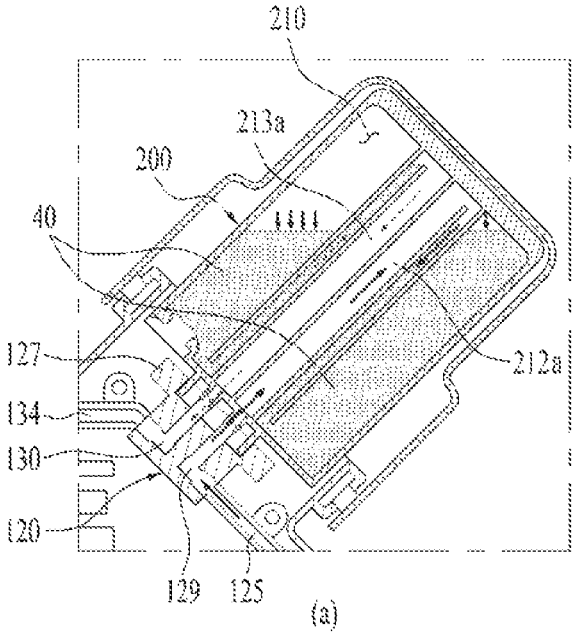
FIG. 17 is a schematic view showing the movement of wash water and contaminated water according to the second use state of the hand-held laundry treating apparatus according to the present invention.
Figure 17:
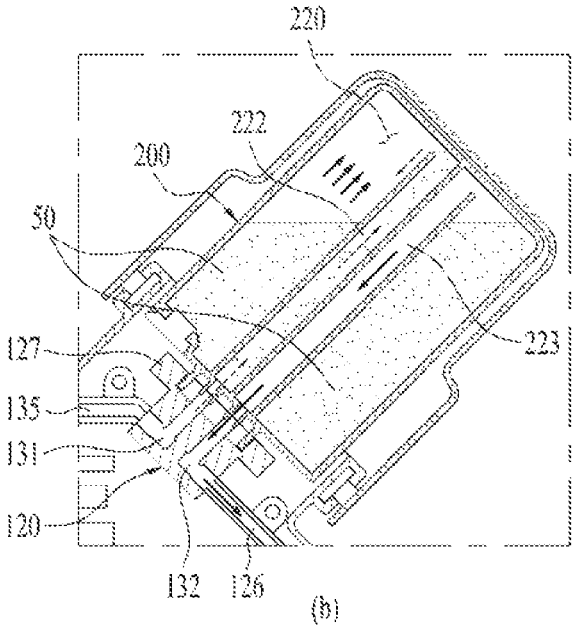

In the use state as described above, wash water 40 is stored in the water tank 200 as shown in FIG. 17(*a*). According to the operation of the air pump 112, air is supplied to the wash water storage unit 210 of the water tank 200 via the air introduction boss 252 of the water tank 200 and the first air introduction channel 212*a* and the second air introduction channel 212*b* of the wash water storage unit 210 to increase pressure in the wash water storage unit 210.

Due to the increase of the pressure in the wash water storage unit 210, the wash water 40 stored in the wash water storage unit 210 is introduced into the second wash water discharge channel 213*b*, is guided to the first wash water discharge channel 213*a* connected to the upper part of the second wash water discharge channel 213*b*, and is discharged through the wash water discharge boss 253.

In addition, contaminated water 50 generated after washing of the laundry 20 is suctioned into the contaminated water collection port 140 due to negative pressure formed at the contaminated water collection port 140, flows along the contaminated water collection channel 135 of the water channel block 133 connected to the contaminated water collection port 140, and is introduced into the contaminated water storage unit 220 of the water tank 200 through the contaminated water collection hole 131 of the tank fastening block 127. At the same time, air around the contaminated water collection port 140 is introduced into the contaminated water collection port 140 together with the contaminated water 50. The air is also introduced into the contaminated water storage unit 220 together with the contaminated water 50. At this time, the contaminated water 50 is stored in the contaminated water storage unit 220 of the water tank 200 as shown in FIG. 17(*b*).

In the hand-held laundry treating apparatus 10 according to the present invention as described above, the channel for supplying the wash water 40 and the channel for collecting the contaminated water 50 are located under the surface of the wash water 40 and the surface of the contaminated water 50 even when the laundry 20 is placed on the horizontal plane or the vertical plane. Consequently, it is possible to supply and collect the wash water 40 and the contaminated water 50 irrespective of the use state of the portable body 100.

As is apparent from the above description, it is possible for the hand-held laundry treating apparatus according to the present invention to simply wash a contaminated portion of a laundry item, rather than wash the entire laundry item. Consequently, the present invention has an effect of reducing consumption of wash water, detergent, and power.

In addition, it is possible for the hand-held laundry treating apparatus according to the present invention to spray wash water to the laundry and, in addition, to collect the wash water and detergent remaining in the laundry. Consequently, the present invention has an effect of improving user convenience.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A hand-held laundry treating apparatus comprising:

a housing forming an external appearance thereof;

a fluid feeding unit mounted inside the housing for supplying and collecting air of a predetermined pressure to circulate the air;

a washing unit mounted inside the housing for spraying wash water to a laundry item and collecting contaminated water;

a vibration unit mounted inside the housing for applying vibration to the laundry item when the wash water is sprayed to the laundry item;

a water tank detachably mounted outside the housing, the water tank configured to separately store the wash water and the contaminated water therein; and a circulation channel unit mounted inside the housing for guiding the air supplied from the fluid feeding unit to the water tank, guiding the wash water from the water tank to the washing unit, guiding the wash water collected from the washing unit to the water tank, and guiding air collected in the water tank together with the contaminated water to the fluid feeding unit.

2. The hand-held laundry treating apparatus according to claim 1, wherein the circulation channel unit comprises:

a pump connection block at which the fluid feeding unit is connected;

a tank fastening block at which the water tank is mounted;

an air channel block defining a path for circulating the air between the pump connection block and the tank fastening block; and a water channel block defining paths between the tank fastening block and the washing unit for the flow of wash water and for the flow of contaminated water.

3. The hand-held laundry treating apparatus according to claim 2, wherein the fluid feeding unit comprises an air pump and a motor for transmitting a driving force to the air pump, the air pump comprising a discharge port for supplying pressurized air and a collection port for collecting air, the air pump being fastened to the pump connection block, and wherein the pump connection block comprises a discharge channel to which the discharge port is connected, and a suction channel to which the collection port is connected.

4. The hand-held laundry treating apparatus according to claim 3, wherein the air channel block comprises:

a discharge extension channel extending a moving path of air moving from the discharge channel to the tank fastening block; and a suction extension channel extending a moving path of air moving from the tank fastening block to the suction channel.

5. The hand-held laundry treating apparatus according to claim 4, wherein the tank fastening block comprises:

a sealing groove at which the water tank is mounted;

an air supply hole, to which the discharge extension channel is connected, for supplying air to the water tank;

a wash water supply hole through which the wash water in the water tank forced out by the air moves;

a contaminated water collection hole for collecting the contaminated water generated in the washing unit; and an air collection hole, to which the suction extension channel is connected, for collecting the air from the water tank.

6. The hand-held laundry treating apparatus according to claim 5, wherein the water channel block comprises:

a wash water supply channel connected to the wash water supply hole for guiding the wash water in the water tank to the washing unit; and a contaminated water collection channel connected to the contaminated water collection hole for guiding the contaminated water in the washing unit to the contaminated water collection hole.

7. The hand-held laundry treating apparatus according to claim 6, wherein the washing unit comprises:

a wash water spray nozzle connected to the wash water supply channel for spraying the wash water to a surface of the laundry item; and a contaminated water collection port connected to the contaminated water collection channel for collecting the contaminated water from the laundry item.

8. The hand-held laundry treating apparatus according to claim 1, wherein the vibration unit comprises:

a motor for generating a rotational force;

an eccentric rotary shaft for converting the rotational force of the motor into a linear reciprocating motion; and a vibrator coupled to the eccentric rotary shaft and configured to apply vibration to the laundry item.

9. The hand-held laundry treating apparatus according to claim 8, wherein the vibration unit further comprises a movable gasket disposed between the vibrator and the washing unit for preventing the wash water and the contaminated water from entering the housing between the vibrator and the washing unit.

10. The hand-held laundry treating apparatus according to claim 1, wherein the vibration unit comprises:

a solenoid configured to perform a linear reciprocating motion; and a vibrator coupled to an end of the solenoid and configured to apply vibration to the laundry item.

11. The hand-held laundry treating apparatus according to claim 10, wherein the vibration unit further comprises a movable gasket disposed between the vibrator and the washing unit for preventing the wash water and the contaminated water from entering the housing between the vibrator and the washing unit.

12. The hand-held laundry treating apparatus according to claim 1, further comprising a rechargeable power supply mounted inside the housing and configured to supply power to the fluid feeding unit and the vibration unit.

13. The hand-held laundry treating apparatus according to claim 1, wherein the housing is provided at one side thereof with a manipulation unit configured to control operation of a power supply unit.

14. The hand-held laundry treating apparatus according to claim 1, wherein the housing is provided at one side thereof with an indication unit configured to indicate an operation state of the hand-held laundry treating apparatus.

15. The hand-held laundry treating apparatus according to claim 1, wherein the water tank comprises:

a body having a shape of a box;

a partition wall partitioning an internal space of the body into a wash water storage unit configured to store the wash water and a contaminated water storage unit configured to store the contaminated water; and a fastening unit provided at a lower part of the body, the fastening unit being fastened to the housing for defining a communication space for the wash water storage unit and the contaminated water storage unit.

16. The hand-held laundry treating apparatus according to claim 15, wherein the fastening unit comprises:

an air introduction boss for supplying external air to the wash water storage unit;

a wash water discharge boss for discharging the wash water stored in the wash water storage unit;

a contaminated water introduction boss for introducing the contaminated water into the contaminated water storage unit; and an air collection boss for discharging air introduced into the contaminated water storage unit.

17. The hand-held laundry treating apparatus according to claim 16, wherein the fastening unit further comprises a sealing protrusion having a shape surrounding the air introduction boss, the wash water discharge boss, the contaminated water introduction boss, and the air collection boss.

18. The hand-held laundry treating apparatus according to claim 16, wherein the wash water storage unit comprises:

a first air introduction channel extending from the air introduction boss to an upper part of the wash water storage unit; and a second air introduction channel connected to an upper part of the first air introduction channel such that the second air introduction channel is open at a lower part of the wash water storage unit.

19. The hand-held laundry treating apparatus according to claim 16, wherein the wash water storage unit comprises:

a first wash water discharge channel extending from the wash water discharge boss to an upper part of the wash water storage unit; and a second wash water discharge channel connected to an upper part of the first wash water discharge channel such that the second wash water discharge channel is open at a lower part of the wash water storage unit.

20. The hand-held laundry treating apparatus according to claim 16, wherein the contaminated water storage unit comprises a contaminated water introduction channel extending from the contaminated water introduction boss to an upper part of the contaminated water storage unit such that the contaminated water introduction channel is open at the upper part of the contaminated water storage unit.

21. The hand-held laundry treating apparatus according to claim 16, wherein the contaminated water storage unit comprises an air collection channel extending from the air collection boss to an upper part of the contaminated water storage unit such that the air collection channel is open at the upper part of the contaminated water storage unit.

22. The hand-held laundry treating apparatus according to claim 15, wherein the wash water storage unit is provided at a lower part thereof with a water supply hole for supplying the wash water into the wash water storage unit, wherein the contaminated water storage unit is provided at a lower part thereof with a drainage hole for draining the contaminated water from the contaminated water storage unit, and wherein the water tank is provided at a lower part thereof with water supply and drainage caps for opening and closing the water supply hole and the drainage hole.

23. The hand-held laundry treating apparatus according to claim 1, wherein the housing is provided at a middle part thereof with a water tank mounting unit at which the water tank is mounted, and wherein the water tank mounting unit comprises a turning clamp for fixing the water tank.

24. The hand-held laundry treating apparatus according to claim 23, wherein the housing is provided at a top thereof with a curved part, having a predetermined curvature, pressed by the turning clamp according to turning of the turning clamp, and a catching projection for restricting the turning of the turning clamp.

* * * * *